US007325704B2

(12) United States Patent
Kasting

(10) Patent No.: US 7,325,704 B2
(45) Date of Patent: Feb. 5, 2008

(54) INVERTED DISPENSING PUMP WITH VENT BAFFLE

(75) Inventor: Thomas P. Kasting, Fort Wayne, IN (US)

(73) Assignee: Rieke Corporation, Auburn, IN (US)

( * ) Notice: Subject to any disclaimer, the term of this patent is extended or adjusted under 35 U.S.C. 154(b) by 447 days.

(21) Appl. No.: 11/024,126

(22) Filed: Dec. 28, 2004

(65) Prior Publication Data

US 2005/0109798 A1 May 26, 2005

Related U.S. Application Data

(63) Continuation-in-part of application No. 10/659,462, filed on Sep. 10, 2003.

(51) Int. Cl.
*B65D 88/54* (2006.01)

(52) U.S. Cl. ..... 222/321.4; 222/564

(58) Field of Classification Search ..... 222/321.4, 222/564, 321.9

See application file for complete search history.

(56) References Cited

U.S. PATENT DOCUMENTS

| | | | | |
|---|---|---|---|---|
| 3,379,136 | A * | 4/1968 | Corsette | 417/313 |
| 4,118,152 | A | 10/1978 | Bron | |
| 4,277,001 | A | 7/1981 | Nozawa | |
| 4,286,736 | A | 9/1981 | Corsette et al. | |
| 4,360,130 | A | 11/1982 | Nishimura et al. | |
| 4,364,718 | A | 12/1982 | Beun et al. | |
| 4,589,573 | A | 5/1986 | Tada | |
| 4,673,109 | A | 6/1987 | Cassia | |
| 4,775,079 | A | 10/1988 | Grothoff | |
| 4,776,498 | A | 10/1988 | Maerte et al. | |
| 4,958,752 | A | 9/1990 | Maerte et al. | |
| 5,016,780 | A | 5/1991 | Moretti | |
| 5,115,980 | A | 5/1992 | Skorka | |
| 5,165,577 | A | 11/1992 | Ophardt | |
| 5,282,552 | A | 2/1994 | Ophardt | |
| 5,353,969 | A | 10/1994 | Balderrama | |
| 5,373,970 | A | 12/1994 | Ophardt | |
| 5,401,148 | A | 3/1995 | Foster et al. | |

(Continued)

FOREIGN PATENT DOCUMENTS

| | | |
|---|---|---|
| EP | 0389688 A1 | 10/1990 |
| EP | 1514607 A2 | 3/2005 |

OTHER PUBLICATIONS

European Patent Application 05256914.2 Extended Search Report mailed Mar. 2, 2006.

(Continued)

*Primary Examiner*—Philippe Derakshani
(74) *Attorney, Agent, or Firm*—Woodard, Emhardt, Moriraty, McNett & Henry LLP

(57) ABSTRACT

A fluid dispensing system includes a pump for pumping fluid from a container. The pump has a vent opening for venting air into the fluid in the container to normalize pressure inside the container as the fluid is pumped. An intake shroud is coupled to the pump, and the shroud includes a channel opening to draw fluid from the container into the pump in a straw-like manner. A baffle is positioned between the vent opening and the channel opening of the shroud to reduce ingestion of the air into the pump so as to reduce short or inconsistent dosing of the fluid when pumped.

25 Claims, 11 Drawing Sheets

U.S. PATENT DOCUMENTS

| | | | | |
|---|---|---|---|---|
| 5,431,309 | A | | 7/1995 | Ophardt |
| 5,445,288 | A | | 8/1995 | Banks |
| 5,489,044 | A | | 2/1996 | Ophardt |
| 5,676,277 | A | | 10/1997 | Ophardt |
| 5,738,250 | A | * | 4/1998 | Gillingham et al. ... 222/153.13 |
| 5,975,360 | A | | 11/1999 | Ophardt |
| 5,988,456 | A | | 11/1999 | Laible |
| 6,045,008 | A | | 4/2000 | Gonzalez Fernandez et al. |
| 6,082,586 | A | | 7/2000 | Banks |
| 6,343,724 | B1 | | 2/2002 | Ophardt et al. |
| 6,409,050 | B1 | | 6/2002 | Ophardt et al. |
| 6,516,976 | B2 | | 2/2003 | Lewis et al. |
| 6,533,145 | B2 | | 3/2003 | Lewis et al. |
| 6,540,117 | B2 | | 4/2003 | Powling |
| 6,540,157 | B2 | | 4/2003 | Ophardt |
| 6,543,651 | B2 | | 4/2003 | Lewis et al. |
| 6,557,736 | B1 | | 5/2003 | Ophardt |
| 6,575,334 | B2 | | 6/2003 | Lewis et al. |
| 6,575,335 | B2 | | 6/2003 | Lewis et al. |
| 6,601,736 | B2 | | 8/2003 | Ophardt et al. |
| 2003/0201286 | A1 | | 10/2003 | Ophardt |
| 2004/0217137 | A1 | | 11/2004 | Ophardt |

OTHER PUBLICATIONS

Pictures of Umbrella Valve from RD Industries of Omaha, Nebraska (Pictures 1-6), Jan. 4, 2005.

Hygiene-Technik Inc., A member of the Ophardt Group of Companies, UX10 Lotion or Foam Soap Dispenser, 2 pages, 2004.

* cited by examiner

INVERTED DISPENSING PUMP WITH VENT BAFFLE

REFERENCE TO RELATED APPLICATIONS

This application is a continuation-in-part of U.S. patent application Ser. No. 10/659,462, filed Sep. 10, 2003, which is hereby incorporated by reference in its entirety.

BACKGROUND

The present invention generally relates to fluid dispensing systems, and more specifically, but not exclusively, concerns a dispensing pump that minimizes leakage and increases of the amount of fluid that can be dispensed from a container.

Fluid dispensing pumps are used in a wide variety of situations. For example, in one common situation, the fluid dispensing pump can be a manually operated pump that is used to dispense liquid hand soap in restrooms. In the case of a fixed (i.e., wall mounted) dispensing pump, aesthetics and security come into play. Typically, the pump in a fixed installation is not readily accessible except by authorized personnel such that the fluid container and associated pumping mechanism are enclosed within a cabinet or docking station. The cabinet usually has some sort of manual actuator device, such as a button or lever that can be used to manually actuate the pump and dispense the fluid. Once the fluid container is emptied, the container can be replaced with a refill unit.

One typical pump design includes a fluid intake valve that controls the fluid flow from the container into the pump, a pumping mechanism such as a piston, and a dispensing port from which the fluid is dispensed. With fluid dispensing pumps, leakage is always a concern. The mess created by the leakage is at least unsightly, and more importantly, the leakage can create hazardous conditions. For example, leakage of liquid soap from a soap dispenser onto a floor can make the floor very slippery. Moreover, fluid leakage is always a concern throughout the life of the pump. When shipping the pump, internal container pressures can fluctuate as a result of temperature changes and/or handling shocks. In the first case, a temperature increase may cause the fluid in the container to expand or gases may out gas from the fluid, thereby increasing the pressure in a fixed volume container. At some point, the pressure inside the container can increase to a great enough level so as to unseat the fluid intake valve in the pump, thereby allowing the fluid to flow into the pump. If allowed to continue, the increased pressure in the pump will cause fluid to leak out the dispensing port of the pump. Once the fluid leaks out the dispensing port, the fluid can collect inside a shipping cap for the pump, if so equipped, and soil the external surfaces of the pump. In the second case, a hydraulic pressure pulse can be mechanically created inside the container by rough or even routine handling. For instance, the hydraulic pressure pulses can be created through container vibration, the container being dropped, and/or through container impact. The hydraulic pressure pulses created through handling can have much of the same affect upon the pump as with temperature changes described above, thereby causing leakage.

Leakage of fluid from the pump can occur through other sources as well. As an illustration, one leakage source in a typical fluid pump comes from fluid remaining within the dispensing port after routine use. As one should appreciate from using hand soap dispensers, the liquid soap remaining in the dispensing port tends to drip and pool on the countertop or the floor. Many factors affect this type of leakage, such as viscosity of the fluid, surface tension, diameter of the dispensing port, and height of the fluid in the dispensing port. Any product residing within the dispensing port will have a certain associated weight. The weight of the fluid in the dispensing port imparts a force, known as head pressure, against the surface tension of the fluid that bridges the opening of the dispensing port. As should be appreciated, the greater the height of the fluid in the dispensing port, the greater weight of the fluid that bears against the surface tension of the fluid at the dispensing port. The greater weight of the fluid in the dispensing port gradually overcomes the surface tension at the opening of the dispensing port. The surface of the fluid at the opening will stretch and bulge beyond the opening of the dispensing port, thereby forming a droplet. At some point the droplet will break free as a result of an external vibration and/or the inability of the fluid to withstand the higher head pressure imparted by the greater weight.

Another leakage source can be caused by the dispensing of fluid. As fluid is dispensed from the container, a vacuum can form inside the container. Left unaddressed, the vacuum inside the container can distort the container, which in turn can cause cracks in the container and subsequent leakage from the cracks. Conceivably, even if no leakage occurs, the vacuum inside the container can become great enough to overcome the ability of the pump to dispense fluid or at the least reduce dispensing dosages.

Another factor in dispensing pump design is the need to have the pump evacuate as much of the contents in the container as possible so as to minimize waste. Typically, in order to minimize the overall container height for shipping purposes, a significant portion of the pump is placed inside the container. For inverted type pumps as well as other type pumps, this arrangement limits the amount of fluid that can be evacuated from the container since the fluid can only be drawn down to the level of the intake valve, which is positioned well inside the container. As a result, the fluid remaining in the container below the inlet valve is wasted.

To reduce vacuum formation inside the container, a number of venting structures have been developed for venting air into the container. However, these structures typically have a number of drawbacks. For example, some systems require that a valve for controlling the inflow of air be positioned inside the container, which makes the pump bulky and difficult to install. With high viscosity fluids, or even low viscosity fluids, air can become trapped in the fluid in the form of bubbles. If not properly addressed, the bubbles of air can enter the pumping chamber, thereby resulting in a short or inconsistent dose of fluid being pumped. Due to this dosing inconsistency, sometimes the pump has to be pumped repeatedly in order to deliver a sufficient amount of fluid, which can become quite frustrating to the user.

Thus, needs remain for further contributions in this area of technology.

SUMMARY

One aspect of the present invention concerns a fluid dispensing system. The system includes a pump body that is constructed and arranged to couple to a container. The pump body defines a fluid inlet opening and a pump cavity. An inlet valve is constructed and arranged to allow fluid from the container to enter the pump cavity through the fluid inlet opening. A plunger is slidably received in the pump cavity, and the plunger defines a fluid passage through which the fluid is dispensed. A shipping seal seals the fluid passage to minimize leakage of the fluid before use.

Another aspect concerns a fluid dispensing system. The system includes a pump body that is constructed and arranged to couple to a container. The pump body defines a fluid inlet opening inside the container and a pump cavity. A plunger is slidably received in the pump cavity to draw fluid from the container into the pump cavity. An intake shroud covers the inlet opening, and the shroud includes a flow channel to draw fluid from the container into the inlet opening.

A further aspect concerns a fluid dispensing system. The system includes a pump body that defines a pump cavity. A plunger is slidably received in the pump cavity, and the plunger defines a fluid passage with a dispensing opening from which fluid is dispensed. An outlet valve is disposed inside the fluid passage to minimize dripping of the fluid from the dispensing opening.

Still yet another aspect concerns a fluid dispensing system. The system includes a pump constructed and arranged to couple to a container for pumping fluid from the container. The pump defines a vent opening for venting air into the container. An intake shroud is coupled to the pump, and the shroud includes a channel opening to draw fluid from the container into the pump. A baffle is positioned between the vent opening and the channel opening to reduce ingestion of the air into the fluid pumped from the pump.

A further aspect concerns a fluid dispensing system that includes a pump body that defines a pump cavity with an inlet opening. A plunger is slidably disposed in the pump cavity to pump fluid. A venting structure is constructed and arranged to alleviate pressure differences created by the plunger pumping the fluid. A baffle is disposed proximal the venting structure to reduce inconsistent dispensing of the fluid.

Another aspect concerns a fluid dispensing system. The system includes means for pumping fluid from a container and means for venting gas into the fluid in the container to normalize pressure inside the container. The system further includes means for directing the gas in the fluid away from being drawn into said means for pumping the fluid.

Further forms, objects, features, aspects, benefits, advantages, and embodiments of the present invention will become apparent from a detailed description and drawings provided herewith.

DESCRIPTION OF THE SELECTED EMBODIMENTS

Figure 1:
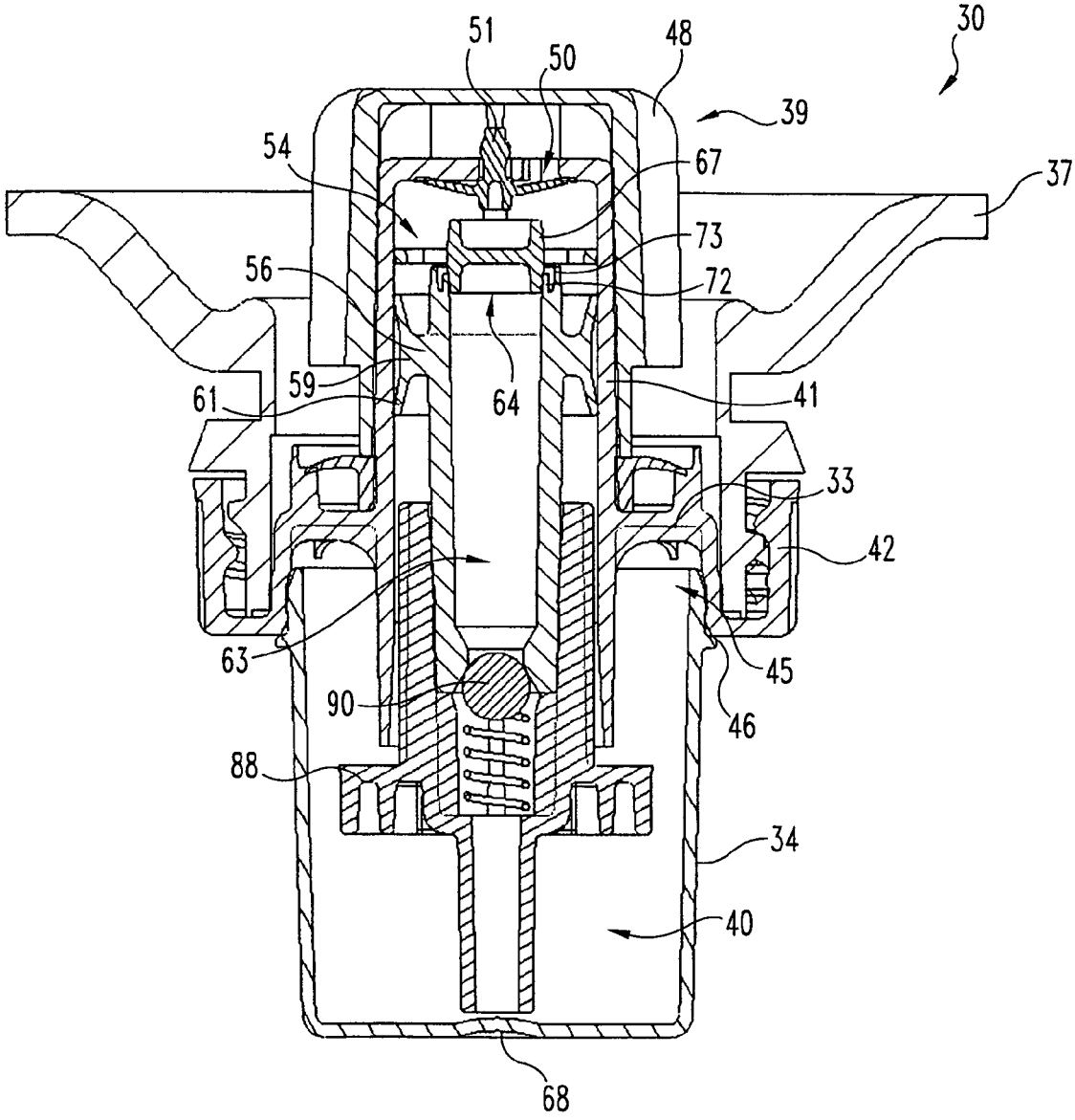
FIG. 1 is a cross sectional view, in full section, of a fluid dispensing system, according to one embodiment of the present invention, oriented in a shipping configuration.

For the purpose of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates. One embodiment of the invention is shown in great detail, although it will be apparent to those skilled in the art that some features that are not relevant to the present invention may not be shown for the sake of clarity.

A fluid dispensing system 30 according to one embodiment, among many embodiments, is illustrated in FIG. 1. The dispensing system 30 includes a fluid pump 33 and a transit cap 34 engaged to the pump 33 in order to promote cleanliness as well as to protect the pump 33 during shipping and/or storage. The dispensing system 30 in the illustrated embodiment is used as a refill (or initial) fluid supply for a fixed manual pump, such as for soap dispensers. It nonetheless should be appreciated that the dispensing system 30 can be used to dispense other types of fluids and also can be used in conjunction with other types of pumping systems. During use, the dispensing system 30 is housed within a cabinet or docking station that has a spring biased lever or other type of actuation member for actuating the pump 33 to dispense fluid. Once emptied, the dispensing system 30 can be removed from the docking station and replaced with another. In the illustrated embodiment, the pump 33 is an inverted type manual pump. However, it is contemplated that features of the present invention can be adapted for use with other types of pumps. As shown, the pump 33 is threadedly engaged to a container 37. Although not illustrated, it should be appreciated that the container 37 is closed so as to hold a fluid. In one form, the container 37 is a bottle. Nevertheless, it should be appreciated that the container 37 can include other types of containers as would occur to those skilled in the art.

As illustrated in FIG. 1, the pump 33 has a fluid intake end portion 39 that is received inside the container 37 and a fluid dispensing end portion 40 that extends from the container 37. In the illustrated embodiment, the pump 33 is generally cylindrical in shape, but it is contemplated that the pump 33 can have a different overall shape in other embodiments. The pump 33 includes a pump body 41 with a threaded container engagement flange 42 that threadedly engages the container 37. Inside the container engagement flange 42, the pump body 41 defines a cap engagement cavity 45 with a cap retention lip 46 (FIG. 2) that detachably retains the cap 34 in the cap engagement cavity 45 during transit and/or storage. At the fluid intake end portion 39, an intake shroud 48 covers the pump body 41. As will be described in greater detail below, the intake shroud 48 is used to increase the amount of fluid that can be dispensed from the container 37. Inside the intake shroud 48, the pump body 41 defines one or more fluid inlet openings 50 through which fluid is supplied to the pump 33. An inlet valve 51 covers and seals the inlet openings 50 during the dispensing stroke of the pump 33. The inlet valve 51 acts as a check valve so that the fluid is only able to flow in one direction, that is into the pump 33. In the illustrated embodiment, the inlet valve 51 includes an umbrella type valve. However, it is contemplated that in other embodiments the inlet valve 51 can include other types of flow control valves.

Figure 2:
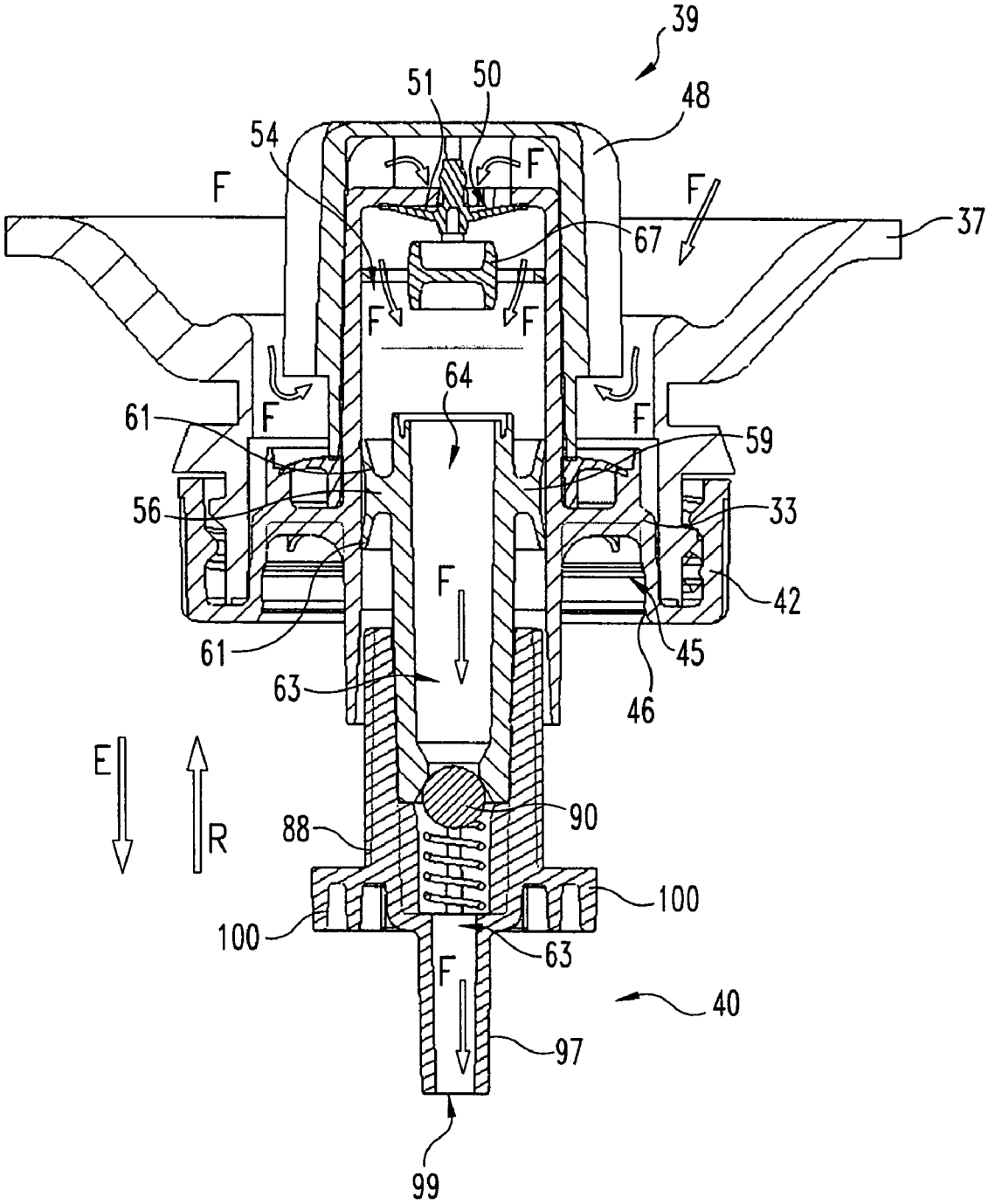
FIG. 2 is a cross sectional view, in full section, of the FIG. 1 fluid dispensing system oriented in a dispensing configuration.

Referring to FIGS. 1 and 2, the pump body 41 defines a pump cavity 54 in which a piston or plunger member 56 is slidably received. The plunger 56 has a plunger seal 59 that engages the walls of the pump cavity 54 in a sealing manner. As shown in the illustrated embodiment, the plunger seal 59 includes a pair of opposing plunger flaps or lips 61 that extend and seal around the plunger 56. A fluid passage 63 is defined inside the plunger 56, and the fluid passage 63 has at least one plunger opening 64 through which the fluid flows when being dispensed. During shipping and/or before use, the plunger 56 is retracted inside the pump cavity 54 so that the plunger opening 64 is plugged with a shipping seal 67, as is illustrated in FIG. 1. Friction between the flaps 61 and the pump body 41 helps to retain the plunger 56 in the retracted position during shipping. The transit cap 34 can also retain the plunger 56 in the retracted or shipping position by including features, such as a dimple 68, that aid in retaining the plunger 56 in the retracted position.

Figure 4:
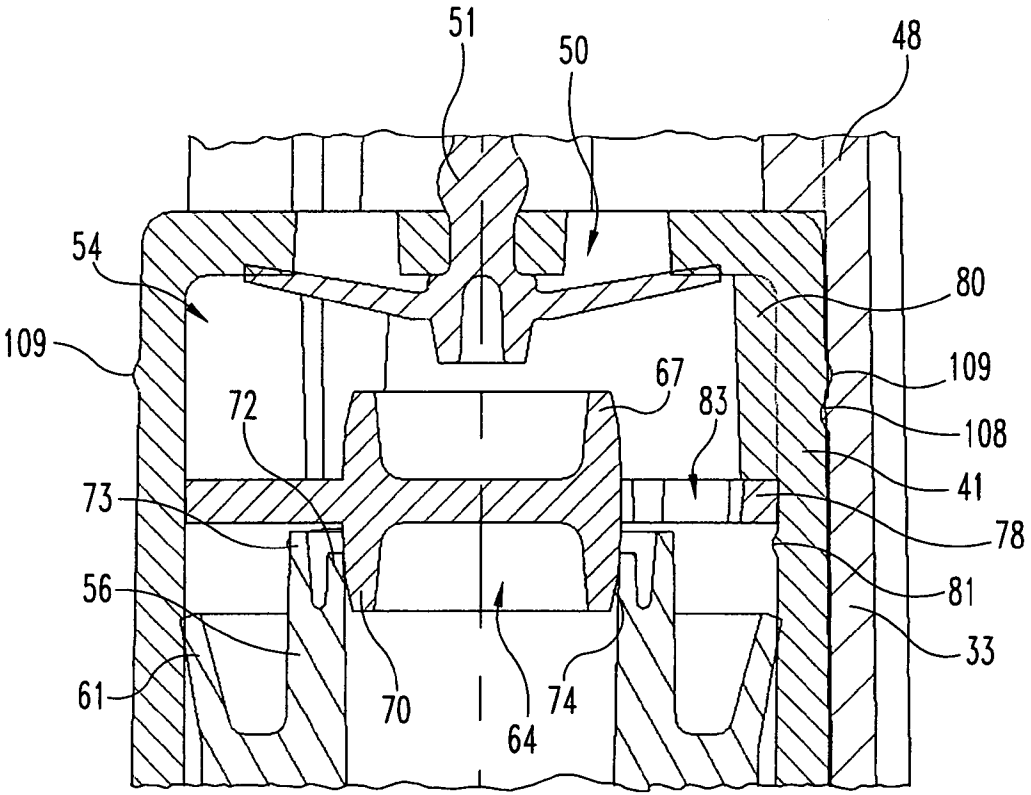
FIG. 4 is an enlarged cross sectional view of a fluid inlet end of the FIG. 1 fluid dispensing system.
Figure 3:
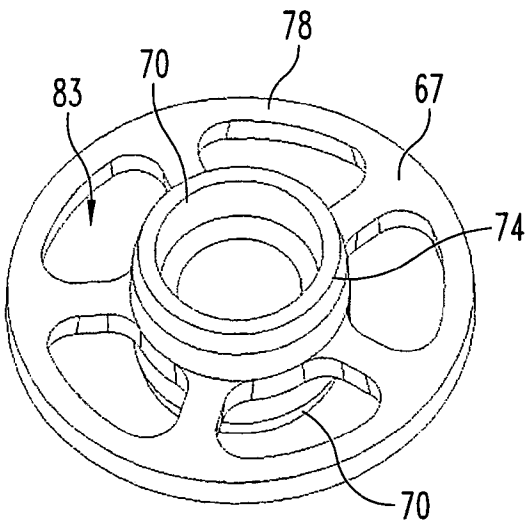
FIG. 3 is a perspective view of a shipping seal used in the FIG. 1 fluid dispensing system.

As discussed above, an increase in pressure in the container 37, caused for example by increased temperatures and/or vibrations, can create pump leakage during shipping or storage. The shipping seal 67 according to the present invention minimizes this type of fluid leakage from the pump 33. Referring to FIGS. 3 and 4, the shipping seal 67 includes a seal member 70 that is closed to seal the plunger opening 64. In the illustrated embodiment, the shipping seal 67 has two seal members 70 extending from opposite sides so that the shipping seal 67 can be easily installed, regardless which side of the shipping seal 67 faces the plunger 56. However, it should be understood that the shipping seal 67 can include more or less seal members 70 than is illustrated. For example, when the plunger 56 has more than one plunger opening 64, the pump 33 can include more than one seal member 70 and/or more than one shipping seal 67 to seal the corresponding plunger openings 64. As depicted in FIG. 4, the plunger 56 has an inner seal ridge 72 positioned inside an outer ridge 73, and the seal member 70 seals inside the inner seal ridge 72. The seal member 70 has a beveled seal edge 74 that centers the seal member 70 within the inner seal ridge 72. As should be appreciated, the seal member 70 in other embodiments can seal the plunger opening 64 in other manners. Surrounding the seal member 70, the shipping seal 67 has a support flange 78 that engages the pump body 41, as illustrated in FIGS. 3 and 4. The pump body 41 has one or more standoff members 80 and one or more snap beads 81 extending inside the pump cavity 54, between which the support flange 78 is secured. With reference to FIG. 3, the support flange 78 of the shipping seal 67 defines one or more flow openings 83 through which fluid flows when being dispensed.

Having the shipping seal 67 seal the plunger opening 64 during transit minimizes the risk of fluid leakage from the pump 33, even if fluid leaks past the inlet valve 51. Once the pump 33 is ready for use, the transit cap 34 is removed so that the plunger 56 can be extended, as is depicted in FIG. 2, thereby disengaging the shipping seal 67 from the plunger opening 64. As soon as the shipping seal 67 disengages from the plunger 56, the fluid is able to flow into the fluid passage 63 in the plunger 56. Fluid flow arrows F in FIG. 2 illustrate the overall flow path of the fluid when dispensed from the pump 33, after the shipping seal 67 is disengaged.

Figure 5:
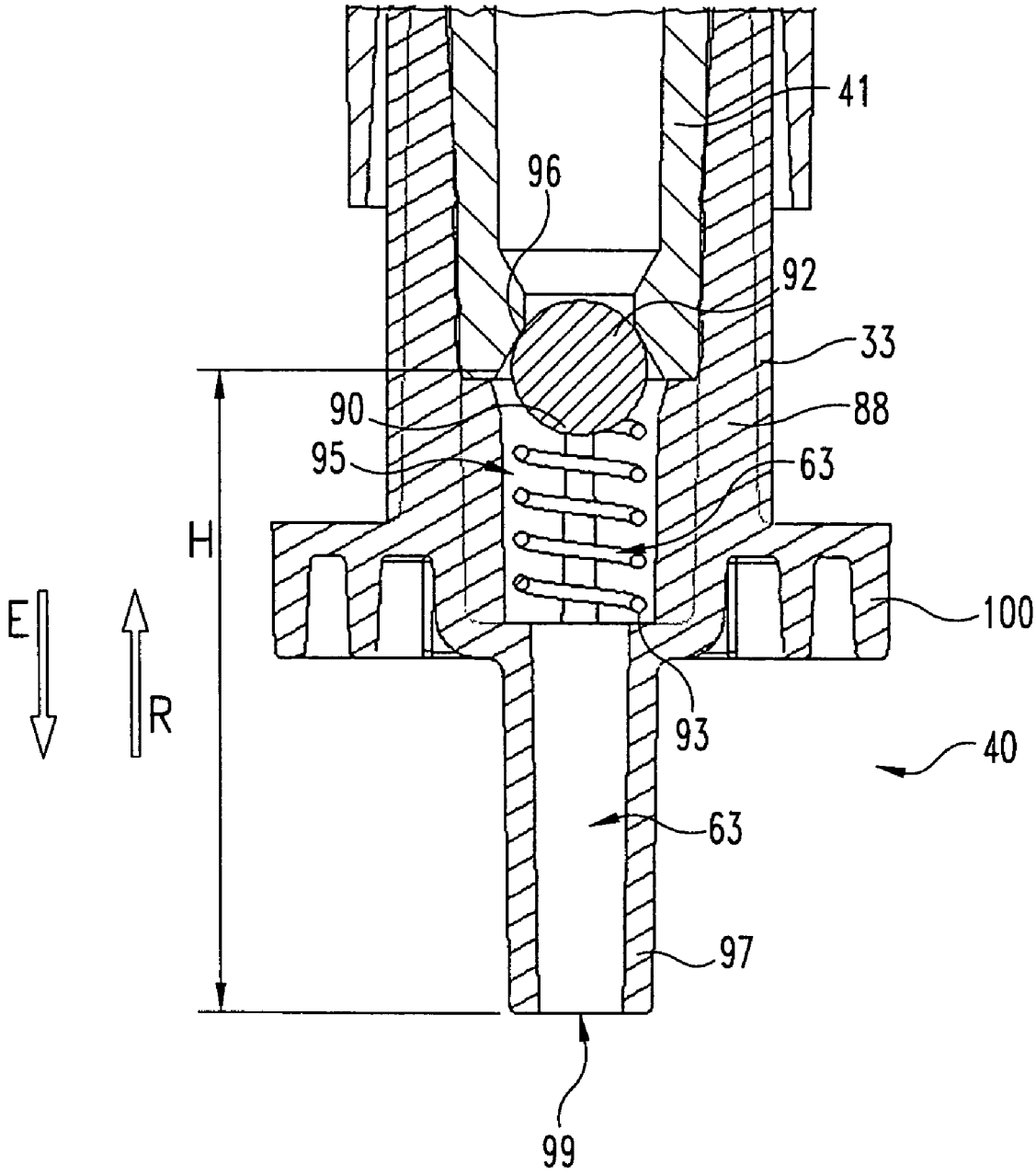
FIG. 5 is an enlarged cross sectional view of a fluid dispensing end of the FIG. 1 fluid dispensing system.

Further, the pump 33 is configured to minimize fluid leaking or dripping from the pump 33 between dispenses. Referring to FIG. 2, a dispensing port 88 is coupled to the pump body 41 at the fluid dispensing end portion 40 of the pump 33. The fluid passage 63 in the plunger 56 further extends into the dispensing port 88. Inside the fluid passage 63, at the interface between the plunger 56 and the dispensing port 88, the pump 33 has an outlet valve 90 that controls the flow of the fluid from the pump 33. The outlet valve 90 in the illustrated embodiment is a check valve that allows the fluid to only flow out of the dispensing port 88. In FIG. 5, the illustrated outlet valve 90 includes a valve member 92, which is spherical or ball-shaped, and a spring 93 for biasing the valve member 92 into a normally closed position. As shown, the dispensing port 88 defines a valve cavity 95 in which the outlet valve 90 is received, and the plunger 56 has a valve seat 96 against which the valve member 92 seals. Downstream from the outlet valve 90, along the fluid passage 63, the dispensing port 88 has a dispensing tip 97 with a dispensing opening 99 through which fluid from the fluid channel 63 is dispensed. As should be appreciated, by positioning the outlet valve 90 inside the fluid passage 63 of the dispensing port 88, height H of fluid between the dispensing opening 99 and the valve member 90 can be minimized. Depending on many factors, including the properties of the fluid being dispensed, such as viscosity, the height H of the fluid inside the dispensing tip 97 can be adjusted so that the surface tension of the fluid at the dispensing opening 99 will be able to easily support the weight of the fluid within the dispensing tip 97, thereby reducing the chance that fluid will drip from the dispensing opening 99.

The dispensing port 88 further incorporates a dispensing flange 100 that is configured to engage an actuation mechanism, such as lever, inside the docking station or cabinet to which the dispensing system 30 is mounted. With reference to FIGS. 2 and 5, during dispensing, the dispensing port 88 along with the plunger 56 are pushed in a retraction direction R into the pump cavity 54. As the plunger 56 moves in direction R, the inlet valve 51 closes the inlet openings 50, and the pressure of the fluid inside the fluid passage 63 causes outlet valve 90 to open. Once the outlet valve 90 opens, the fluid is dispensed from the dispensing opening 99. To refill the pump cavity 54 with fluid for the next dispensing stroke, the dispensing port 88 along with the plunger 56 are pulled in extension direction E to extend from the pump 33. In one type of installation, the actuation mechanism, such as a lever in the docking station or cabinet, has a spring that biases the dispensing port 88 in the extension direction E. It is contemplated that in other types of installations the dispensing port 88 can manually or automatically moved in the extension direction E. As the plunger 56 extends in direction E, the outlet valve 90 closes and the inlet valve 51 opens, thereby allowing the fluid to flow into and fill the pump cavity 54 for subsequent dispensing.

As mentioned above, in order to lower the overall profile of the dispensing system 33, the fluid intake end portion 39 of the pump 33 extends inside the container 37. However, by positioning the fluid intake end portion 39 of the pump 33 inside the container other design concerns are created. For instance, as depicted in FIGS. 1 and 2, the inlet openings 50 are positioned deeper inside the container 37 such that any fluid below the inlet openings 50 will never be dispensed, and thus, wasted. Not only is cost of the wasted fluid a concern, but also the labor costs associated with the increased replacement frequency of the dispensing system 33 may be an even greater concern. Although the inlet openings 50 can be positioned at a lower position on the pump body 41, the ultimate location of the fluid inlet openings 50 is still limited by position of the plunger 56. The inlet openings 50 need to be located so that the plunger 56 is able to draw the fluid. As briefly noted above, the intake shroud 48 is able to increase the evacuation efficiency of the pump 33. By way of analogy, the intake shroud 48 acts like a straw to draw fluid in the neck of the container 37 that is below the inlet openings 50 through the inlet openings 50 and into the pump cavity 54.

Figure 7:
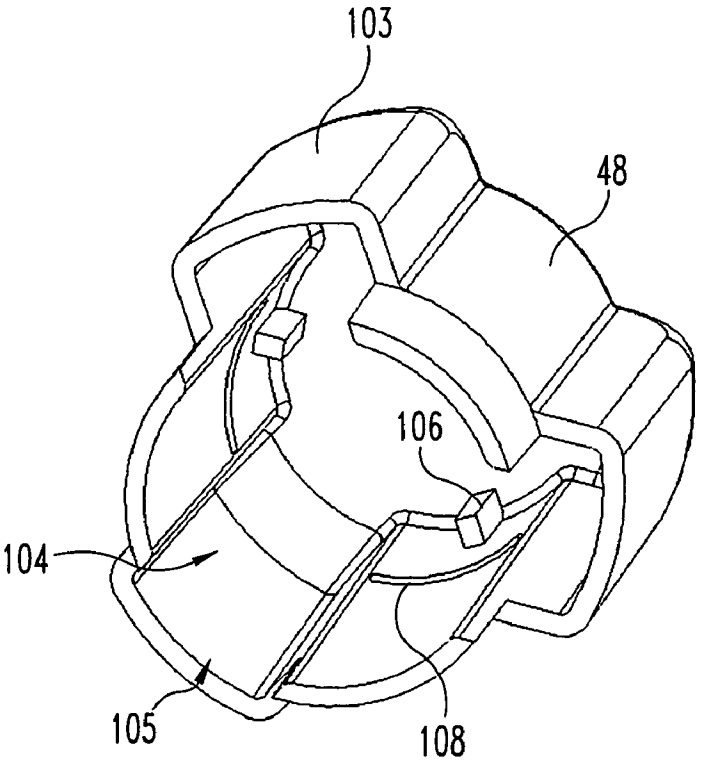
FIG. 7 is a bottom perspective view of the FIG. 6 intake shroud.
Figure 6:
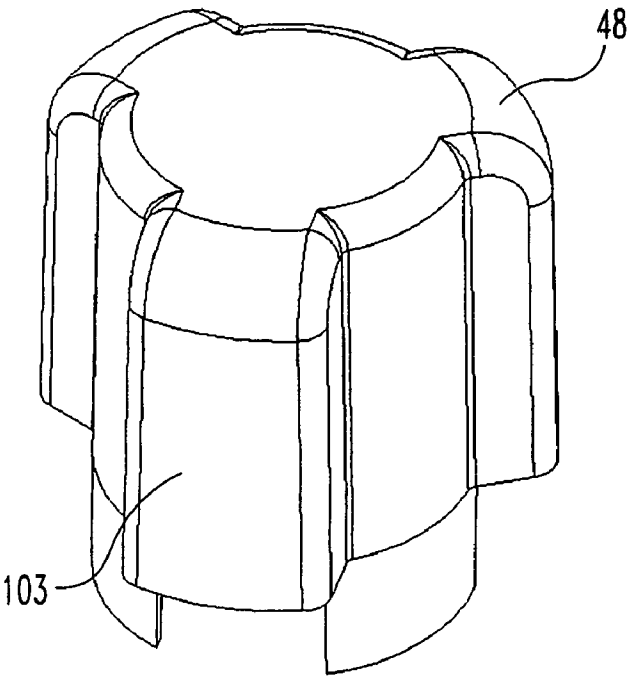
FIG. 6 is a top perspective view of an intake shroud used in the FIG. 1 fluid dispensing system.
Figure 8:
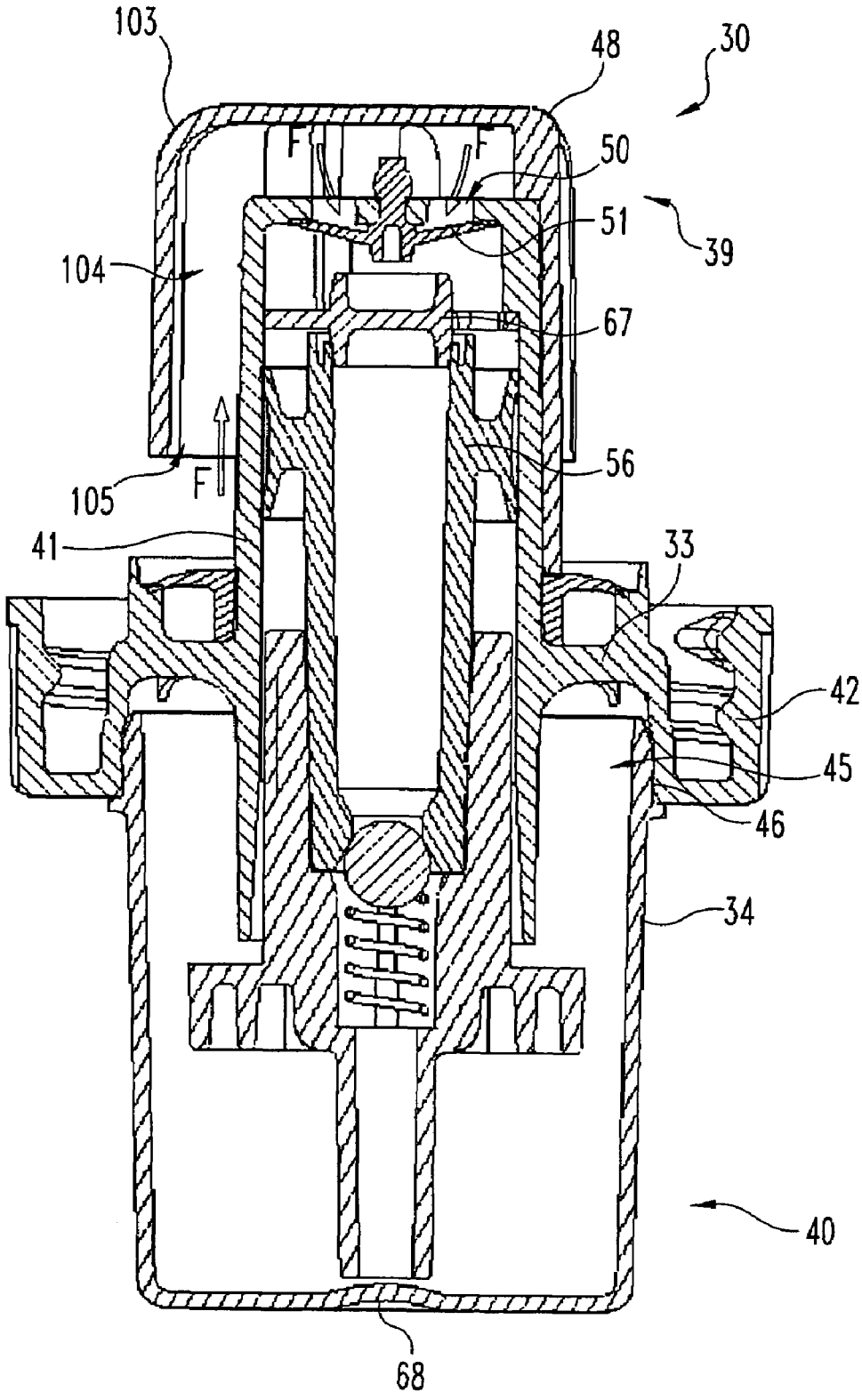
FIG. 8 is a cross sectional view, in full section, of the FIG. 1 fluid dispensing system illustrating a flow channel in the FIG. 6 intake shroud.
Figure 9:
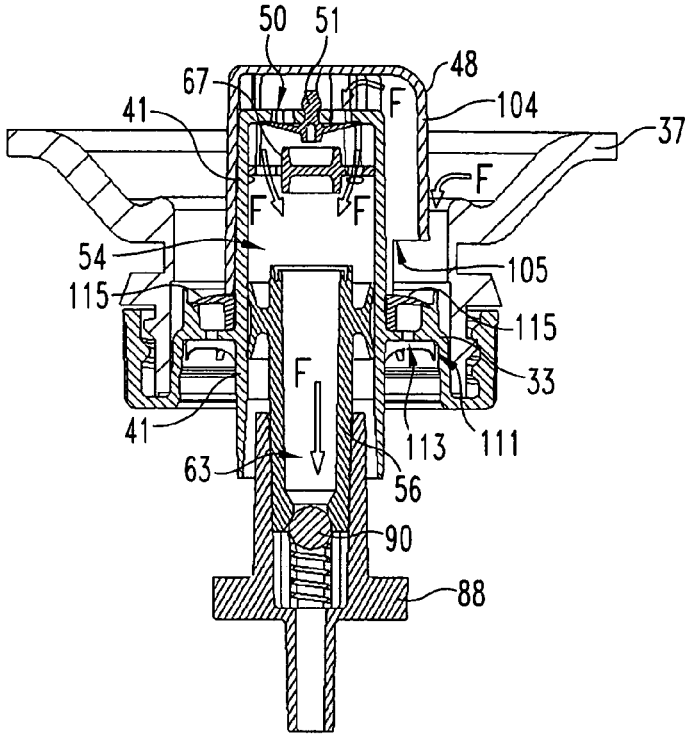
FIG. 9 is a cross sectional view, in full section, of the FIG. 1 fluid dispensing system illustrating a venting structure in the FIG. 1 fluid dispensing system.

With reference to FIGS. 6 and 7, the intake shroud 48 has one or more flow members 103 that define one or more flow channels 104 with channel openings 105, through which fluid is drawn from the container 37 and into the pump 33. Inside the intake shroud 48, one or more shroud standoffs 106 space the intake shroud 48 from the pump body 41 so as to allow the fluid to flow between the intake shroud 48 and the pump body 41. Further, the intake shroud 48 has one or more body engagement snap beads 108 that are configured to secure the intake shroud 48 onto the pump body 41. As illustrated in FIG. 4, the body engagement snap beads 108 engage one or more shroud engagement snap beads 109 on the pump body 41 so that the intake shroud 48 is secured to the rest of the pump 33. As shown in FIGS. 8 and 9, once the intake shroud 48 is secured, the flow channels 104 extend along the pump body 41 towards the fluid dispensing end portion 40 of the pump 33. The channel openings 105 of the flow channels 104 open below the fluid inlet openings 50 so as to increase the amount of fluid that is able to be evacuated from the container 37. With the intake shroud 48 secured in such a manner, the fluid below the inlet openings 50 is able to flow into the pump 33 through the flow channels 104, as depicted with fluid flow arrows F.

Figure 10:
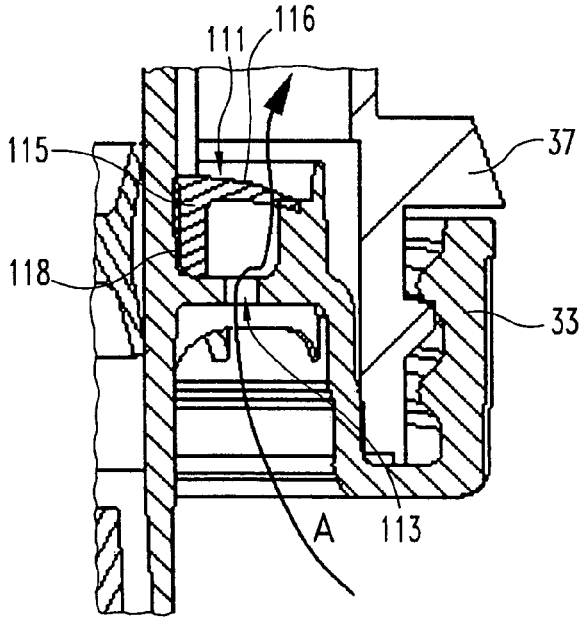
FIG. 10 is an enlarged cross sectional view of the FIG. 9 venting structure.

As previously discussed, when fluid is pumped from the container 37, a vacuum (i.e., low pressure) can be formed inside the container 37 as a result of the fluid being removed from the container 37. If left unchecked, the vacuum can distort the container 37 such that cracks can form in the container 37, and these cracks can create a leakage source. Referring to FIG. 9, the pump 33 has a venting structure 111 that is configured to equalize the air pressure inside the container 37 with ambient conditions while at the same time prevent fluid leakage from the dispensing system 30. The venting structure 111, according to the illustrated embodiment, includes one or more vent openings 113 defined in the pump body 41 and at least one vent seal 115 positioned to seal the vent openings 113. As shown in FIG. 10, the vent seal 115 is sandwiched between the intake shroud 48 and the vent body 41. In one form, the vent seal 115 is ring-shaped and includes a vent flap 116 that extends from a body portion 118. When a vacuum forms inside the container 37, the vent flap 116 is able to deflect and allow air (or some other gas) flow into the container 37 to alleviate the vacuum, as is indicated by air flow arrow A in FIG. 10. Once the pressure is equalized, the vent flap 116 of the vent seal 115 reseals the vent openings 113 to prevent fluid leakage from the vent openings 113.

Figure 11:
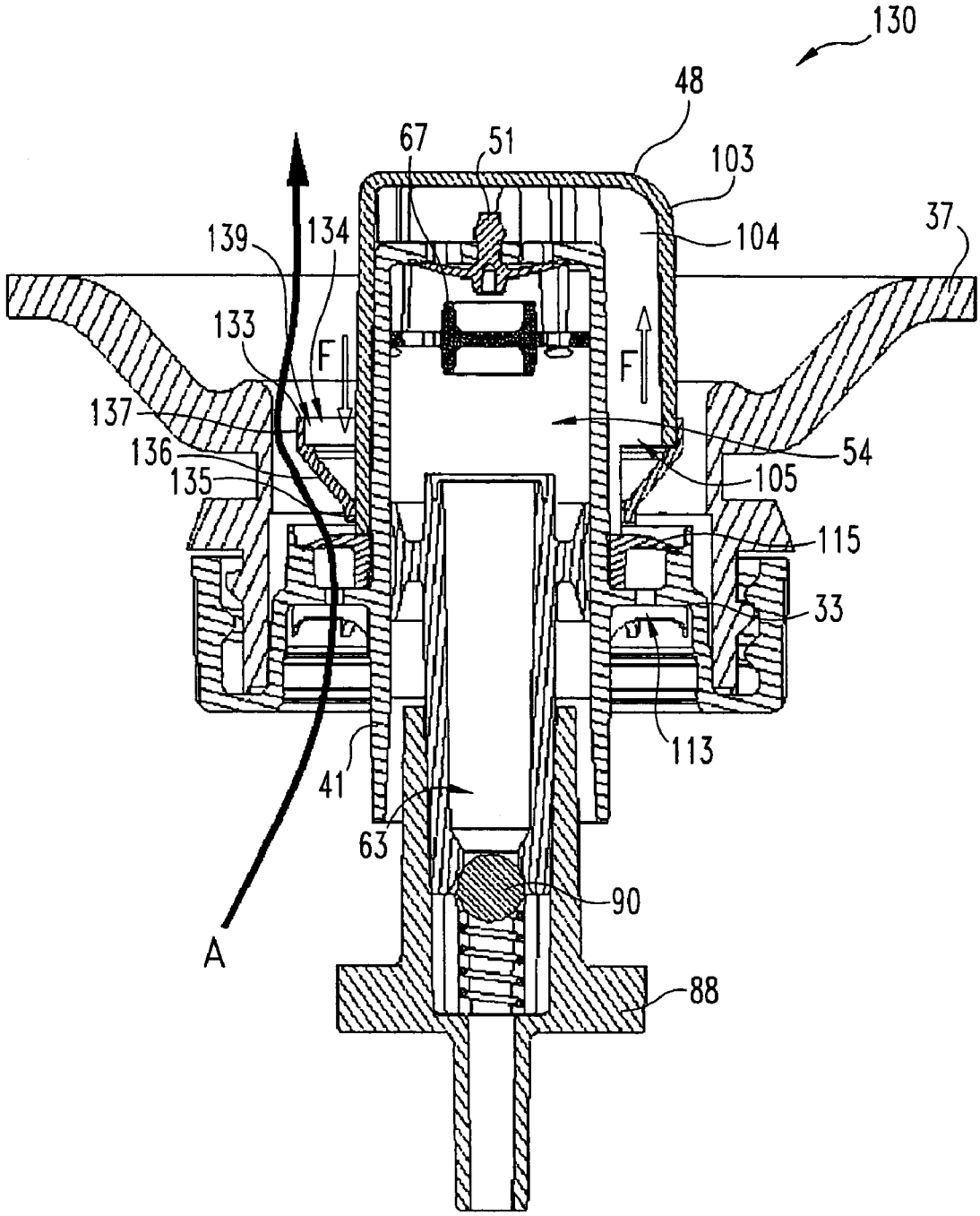
FIG. 11 is a cross sectional view, in full section, of a fluid dispensing system with a vent baffle according to another embodiment.

Bubbles of air rise from the vent openings 113 through the fluid as the pressure in the container 37 is normalized, and these bubbles can rise rapidly or slowly, depending on the viscosity of the fluid being dispensed. Sometimes, these bubbles of air are drawn into the pumping chamber, thereby resulting in a short or inconsistent dose of the fluid being pumped. For example, with the venting structure 111 in FIG. 10, the air from the vent openings 113 has a significant opportunity to rise and enter the channel openings 105 of the flow channels 104 as fluid is drawn into the pump 33. The ingested air bubbles are in turn drawn into the pump cavity 54 and result in a short or inconsistent dose. A fluid dispensing system 130 according to another embodiment that alleviates this air bubble ingestion issue is illustrated in FIG. 11. As can be seen, the fluid dispensing system 130 in FIG. 11 shares a number of components and features in common with the fluid dispensing pump 30 of FIG. 1. For the sake of brevity as well as clarity, these common features will not be discussed again in detail below, but rather, reference is made to the previous discussion of the FIG. 1 fluid dispensing pump 30.

In comparison to the FIG. 1 fluid dispensing pump 30, the fluid dispensing pump 130 in FIG. 11 further includes an air/gas baffle member 133 that directs the flow of air A from the vent openings 113 away from the channel openings 105 of the flow channels 104 in the intake shroud 48. As shown, the baffle member 133 is generally shaped like a funnel with a baffle cavity 134 that faces the shroud 48. Specifically, the baffle member 133 has a shroud engagement portion 135 that is ring-shaped so as to fit around the base of the intake shroud 48. A tapered wall 136 outwardly extends to connect the shroud engagement portion 135 to a flow channel engagement portion 137. As depicted, the channel engagement portion 137 is ring-shaped and extends past the channel openings 105 of the intake shroud 48. The channel engagement portion 137 has a groove 139 in which the ends of the flow members 103 are received such that the air baffle member 133 is able to divert bubbles of air or other gas away from the channel openings 105. In particular, the tapered wall 136 of the baffle member 133 directs the bubbles away from the channel openings 105 as the bubbles rise. Even though the air bubbles are diverted away, the fluid is able to flow around inside the baffle cavity 134 and into the channel openings 105, as is indicated by flow arrow F. In the illustrated embodiment, the baffle member 133 is shaped like a funnel, but it is contemplated that the baffle member 133 can be shaped differently in other embodiments, while still being able to divert air or other gas bubbles in the fluid away from the channel openings 105 of the intake shroud 48.

Figure 12:
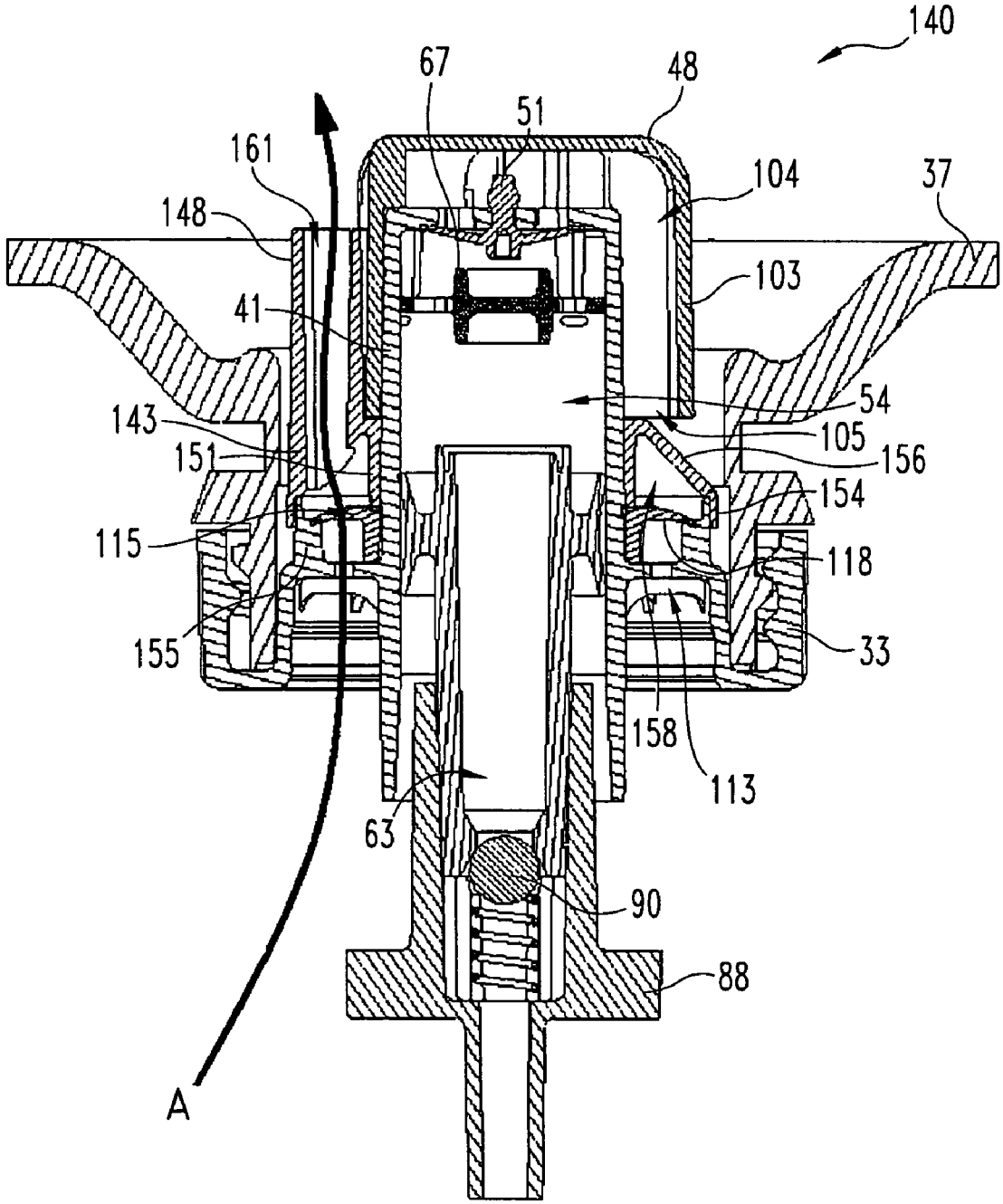
FIG. 12 is a cross sectional view, in full section, of a fluid dispensing system with a chimney type baffle according to a further embodiment.
Figure 13:
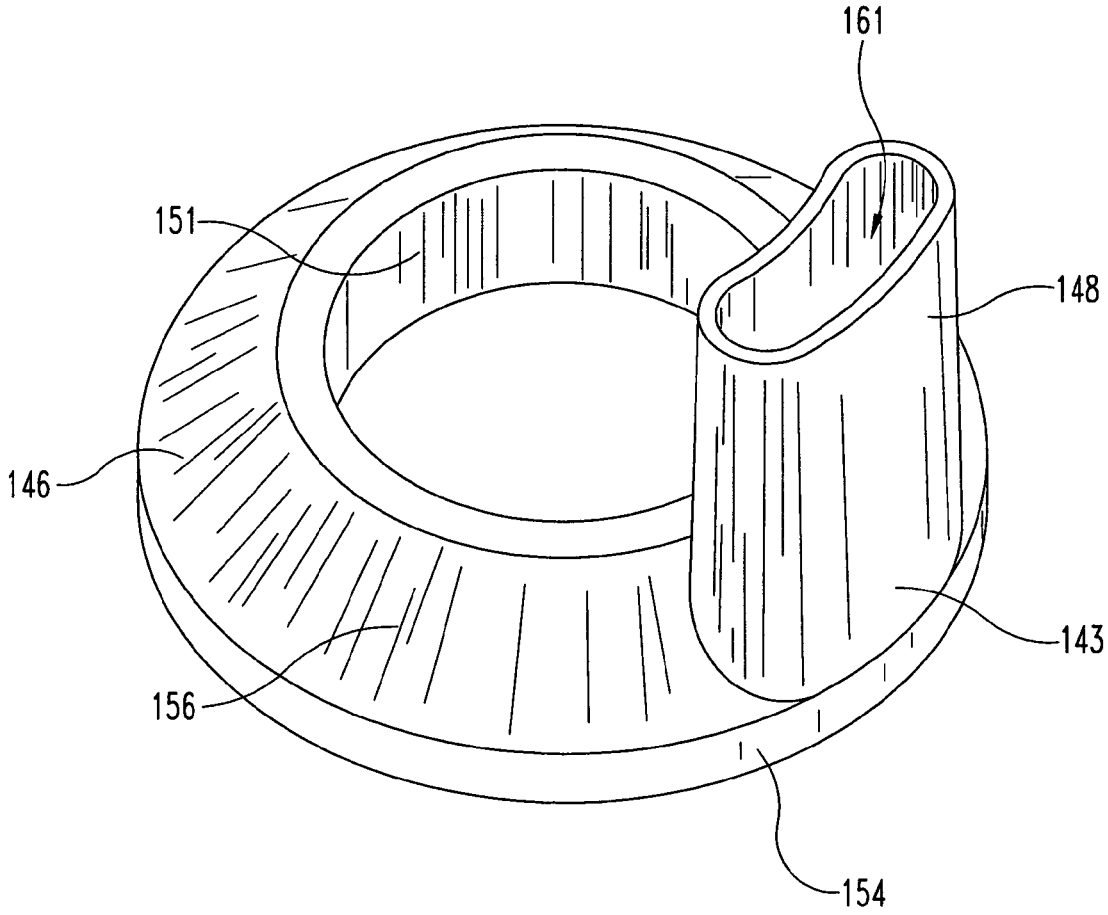
FIG. 13 is a perspective view of the chimney type baffle of FIG. 12.

In higher viscosity fluids, the air bubbles from the vent openings 113 tend to rise very slowly in the fluid. As such, the air bubbles occasionally can remain near the channel engagement portion 137 of the baffle member 133 such that the air bubbles are able to be sucked into the channel openings 105 of the shroud 48 during the intake stroke of the pump 33. This again causes the pump 33 to ingest bubbles of air or other gases, thereby leading to short or inconsistent doses of the fluid being pumped. A fluid dispensing pump 140, according to a further embodiment, with a baffle member 143 configured to reduce ingestion of bubbles in higher viscosity fluids is illustrated in FIG. 12. Most of the components in the fluid dispensing pump 140 in FIG. 12 are the same as those illustrated in the FIG. 11 fluid dispensing pump 130, with the exception that the air baffle member 143 is shaped differently. Like before, these common features will not be again discussed in great detail below for the sake of brevity as well as clarity, but reference is made to the previous description of these features. Looking at FIGS. 12 and 13, the air baffle member 143 has a collection portion 146 for collecting air bubbles or other gases from the vent openings 113 along with a chimney portion 148 that directs the collected air away from the channel openings 105 in the shroud 48.

In the illustrated embodiment, the collection portion 146 includes an inner radial wall 151 that is disposed around the pump body 41. An outer radial wall 154 of the collection portion 146 engages around a valve seat member 155 of the pump body 41. A connecting wall 156 of the collection portion 146 spans between the inner 151 and outer 154 radial walls. As depicted, the collection portion 146 is generally frustoconical in shape with the connecting wall 156 angling away from the channel openings 105 of the intake shroud 48, but it should be realized that the collection portion 146 can be shaped differently. Together, the walls 151, 154, 156 of the collection portion 146 define a collection cavity 158 in which air or other gases are collected. The chimney 148 defines a vent channel 161 with a vent opening 162 from where the air in the collection cavity 158 is vented away from the channel openings 105 of the shroud 48.

Figure 14:
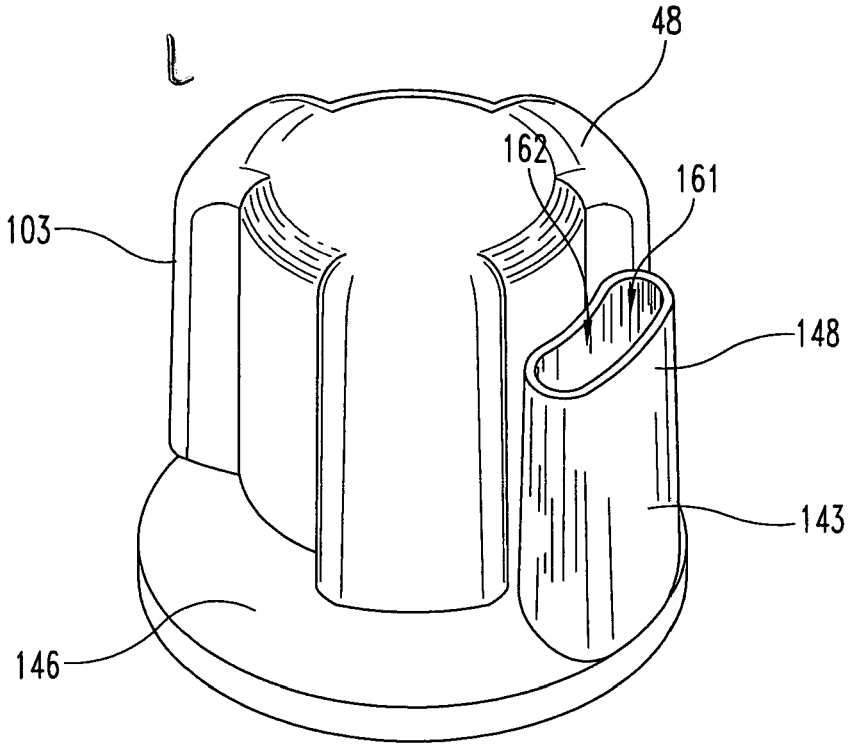
FIG. 14 is a perspective view of a sub-assembly that includes the FIG. 13 chimney type baffle and the FIG. 6 intake shroud.
Figure 15:
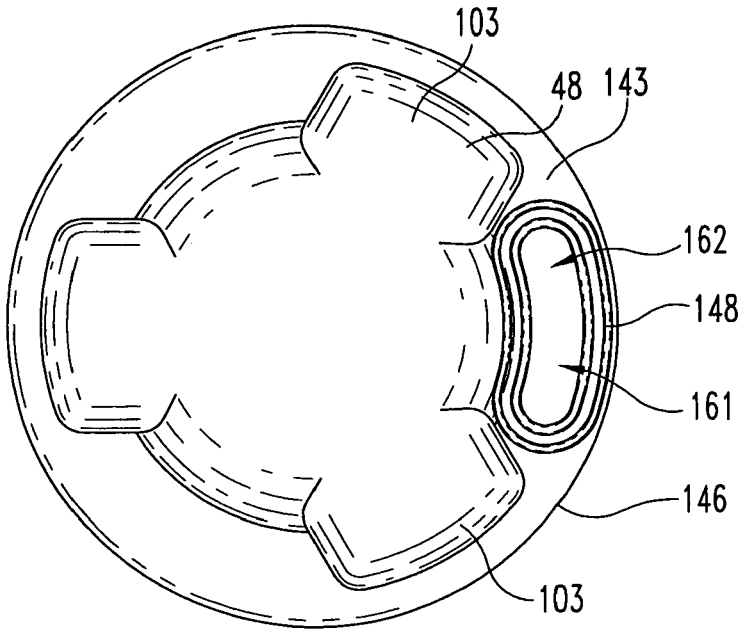
FIG. 15 is a top, plan view of the FIG. 14 sub-assembly.

With reference to FIGS. 14 and 15, the chimney 148 in the illustrated embodiment is positioned between adjacent flow members 103 of the shroud 48 so as to conserve space as well as position the vent opening 162 away the channel openings 105 in the shroud 48. However, the chimney 148 in other embodiments can be positioned elsewhere, and although only one chimney 148 is illustrated in the drawings, it is envisioned that other embodiments can incorporate more than one chimney 148. In the embodiment shown, the vent opening 162 of the chimney 148 is oblong-shaped, but the vent opening 162 along with the rest of the chimney 148 can be shaped differently in other embodiments. The length of the chimney 148 can vary due to many factors so that the chimney 148 can be longer or shorter than is shown. For example, the chimney 148 can be longer for fluids with higher viscosities and shorter for fluids with lower viscosities. Also, the length of the chimney 148 can vary depending on the position of chimney 148 relative to the channel openings 105 as well as due to many other factors. With the chimney 148, the air baffle member 143 is able to direct vented air away from the channel openings 105, thereby reducing the risk of air bubbles being ingested into the fluid pump 33 and causing short or inconsistent fluid doses.

From the discussion above, it should be recognized that the air baffle members in the illustrated embodiments can be incorporated into other type pumping systems. As one example, the baffle members can be incorporated into pump systems that do not include an intake shroud or have the air inlet openings located at positions different from those shown. Other components of the illustrated embodiment can be incorporated into other types of pumping systems as well.

While the invention has been illustrated and described in detail in the drawings and foregoing description, the same is to be considered as illustrative and not restrictive in character, it being understood that only the preferred embodiment has been shown and described and that all changes, equivalents, and modifications that come within the spirit of the inventions defined by following claims are desired to be protected. The abstract and summary sections of this document have been provided solely for the purpose of assisting examiners and patent searchers during patent searches by briefly identifying the general technology described and illustrated in this document. The abstract and summary sections should not be used to restrict the coverage of the claims or to limit the definition of terms used in the claims. All publications, patents, and patent applications cited in this specification are herein incorporated by reference as if each individual publication, patent, or patent application were specifically and individually indicated to be incorporated by reference and set forth in its entirety herein.

What is claimed is:

1. A fluid dispensing system, comprising:

a pump constructed and arranged to couple to a container for pumping fluid from the container, the pump defining a vent opening for venting air into the container;

an intake shroud coupled to the pump, the shroud including a channel opening to draw fluid from the container into the pump;

a baffle positioned between the vent opening and the channel opening to reduce ingestion of the air into the fluid pumped from the pump; and wherein the baffle includes a collection portion positioned proximal the vent opening for collecting the air from the vent opening and a chimney extending from the collection portion for directing the air away from the channel opening.

2. A fluid dispensing system, comprising:

a pump constructed and arranged to couple to a container for pumping fluid from the container, the pump defining a vent opening for venting air into the container;

an intake shroud coupled to the pump, the shroud including a channel opening to draw fluid from the container into the pump;

a baffle positioned between the vent opening and the channel opening to reduce ingestion of the air into the fluid pumped from the pump; and wherein the baffle is funnel shaped with an angled wall that extends radially outwards around the channel opening.

3. The system of claim 1, wherein:

the shroud includes at least two channel members with each having the channel opening; and the chimney extends between the channel members.

4. The system of claim 1, further comprising the container.

5. The system of claim 4, wherein:

the container is inverted;

the pump cavity has an inlet opening; and the channel opening of the shroud opens at a position below the inlet opening in the container.

6. The system of claim 5, wherein:

the vent opening is positioned below the channel opening; and the baffle is positioned below the channel opening and above the vent opening.

7. The system of claim 1, further comprising:

a vent seal disposed to seal the vent opening; and the baffle is positioned between the vent seal and the channel opening of the shroud.

8. The system of claim 1, further comprising a shipping seal disposed at least partially inside the pump to minimize fluid leakage during shipping.

9. The system of claim 1, further comprising:

wherein the pump includes a plunger that defines a fluid passage that dispenses the fluid; and an outlet valve disposed inside the fluid passage to minimize fluid leakage between dispenses.

10. The system of claim 2, further comprising:

the container, wherein the container is inverted;

the pump cavity having an inlet opening;

the channel opening of the shroud opening at a position below the inlet opening in the container;

the vent opening being positioned below the channel opening; and the baffle being positioned below the channel opening and above the vent opening.

11. The system of claim 2, further comprising:

a vent seal disposed to seal the vent opening; and the baffle is positioned between the vent seal and the channel opening of the shroud.

12. The system of claim 2, further comprising a shipping seal disposed at least partially inside the pump to minimize fluid leakage during shipping.

13. The system of claim 2, further comprising:

wherein the pump includes a plunger that defines a fluid passage that dispenses the fluid; and an outlet valve disposed inside the fluid passage to minimize fluid leakage between dispenses.

14. A fluid dispensing system, comprising:

a pump body defining a pump cavity with an inlet opening;

a plunger slidably disposed in the pump cavity to pump fluid;

a venting structure constructed and arranged to alleviate pressure differences created by the plunger pumping the fluid;

a baffle disposed proximal to the venting structure to reduce inconsistent dispensing of the fluid; and wherein the baffle includes a chimney.

15. The system of claim 14, wherein the venting structure includes a vent opening.

16. The system of claim 15, wherein the venting structure further includes a seal positioned to seal the vent opening.

17. The system of claim 14, wherein the pump body defines the vent opening.

18. The system of claim 14, further comprising a shroud covering the inlet opening to draw the fluid into the pump cavity in a straw-like manner.

19. The system of claim 14, further comprising:

means for pumping the fluid from a container, wherein the means for pumping the fluid includes the pump body with the pump cavity and the plunger slidably disposed in the pump cavity;

means for venting gas into the fluid in the container to normalize pressure inside the container, wherein the means for venting the gas includes the venting structure; and means for directing the gas in the fluid away from being drawn into the means for pumping the fluid, wherein the means for directing the gas includes the baffle.

20. A fluid dispensing system, comprising:

a pump body defining a pump cavity with an inlet opening;

a plunger slidably disposed in the pump cavity to pump fluid;

a venting structure constructed and arranged to alleviate pressure differences created by the plunger pumping the fluid;

a baffle disposed proximal to the venting structure to reduce inconsistent dispensing of the fluid; and wherein the baffle is funnel-shaped.

21. The system of claim 20, further comprising:

means for pumping the fluid from a container, wherein the means for pumping the fluid includes the pump body with the pump cavity and the plunger slidably disposed in the pump cavity;

means for venting gas into the fluid in the container to normalize pressure inside the container, wherein the means for venting the gas includes the venting structure; and means for directing the gas in the fluid away from being drawn into the means for pumping the fluid, wherein the means for directing the gas includes the baffle.

22. The system of claim 20, wherein the venting structure includes a vent opening.

23. The system of claim 22, wherein the venting structure further includes a seal positioned to seal the vent opening.

24. The system of claim 20, wherein the pump body defines the vent opening.

25. The system of claim 20, further comprising a shroud covering the inlet opening to draw the fluid into the pump cavity in a straw-like manner.

* * * * *